US009745027B2

(12) United States Patent
Guffee

(10) Patent No.: US 9,745,027 B2
(45) Date of Patent: Aug. 29, 2017

(54) DEPLOYMENT OF HIGH-PRESSURE IRON FROM MARINE VESSEL TO OFFSHORE RIG

(71) Applicant: Halliburton Energy Services, Inc., Houston, TX (US)

(72) Inventor: Larry Edwin Guffee, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/103,134

(22) PCT Filed: Jan. 22, 2014

(86) PCT No.: PCT/US2014/012507
§ 371 (c)(1),
(2) Date: Jun. 9, 2016

(87) PCT Pub. No.: WO2015/112134
PCT Pub. Date: Jul. 30, 2015

(65) Prior Publication Data

US 2016/0304170 A1 Oct. 20, 2016

(51) Int. Cl.
*B63B 27/34* (2006.01)
*B63B 27/10* (2006.01)

(52) U.S. Cl.
CPC ..... *B63B 27/34* (2013.01); *B63B 27/10* (2013.01)

(58) Field of Classification Search
CPC ..... B63B 27/34; B63B 27/10
USPC ..... 441/133
See application file for complete search history.

(56) References Cited

U.S. PATENT DOCUMENTS 2,648,201 A * 8/1953 Marancik ..... B63B 22/023 114/74 R
3,452,787 A * 7/1969 Bily ..... B63B 22/023 137/236.1
3,841,357 A * 10/1974 Heijst ..... F16L 27/0861 138/120
4,065,822 A * 1/1978 Wilbourn ..... B63B 22/021 114/230.22

(Continued)

FOREIGN PATENT DOCUMENTS

EP 1078144 B1 11/2005
KR WO 2009102168 A2 * 8/2009 ..... B60P 3/055
WO 2009/102168 A2 8/2009

OTHER PUBLICATIONS

International Search Report and Written Opinion issued in related PCT Application No. PCT/US2014/012507 dated Oct. 13, 2014, 15 pages.

(Continued)

*Primary Examiner* — Lars A Olson
*Assistant Examiner* — Jovon Hayes
(74) *Attorney, Agent, or Firm* — John W. Wustenberg; Baker Botts L.L.P.

(57) ABSTRACT

A system and method for the deployment of a conduit system to convey fluids from a marine vessel to an offshore rig are provided. In one embodiment, the disclosure provides a conduit connected to a marine vessel, the conduit comprising: a plurality of sections of tubing; a plurality of flexible joints connecting the sections of tubing; and a buoyancy device at least partially surrounding at least one of the sections of tubing and having a density less than the density of seawater.

18 Claims, 5 Drawing Sheets

(56) References Cited

U.S. PATENT DOCUMENTS 4,100,752 A * 7/1978 Tucker ..... B63B 22/021 405/170
4,265,567 A * 5/1981 Nybo ..... B63B 22/021 166/367
4,416,473 A * 11/1983 Lamy ..... E21B 17/085 285/223
4,448,568 A * 5/1984 Gentry ..... B63B 22/021 166/345
4,490,121 A * 12/1984 Coppens ..... B63B 21/50 114/230.15
4,906,137 A * 3/1990 Maloberti ..... E21B 17/015 166/338
5,553,976 A * 9/1996 Korsgaard ..... E21B 17/22 138/113
5,615,977 A * 4/1997 Moses ..... E21B 17/015 166/350
6,364,022 B1 * 4/2002 Kodaissi ..... E21B 17/015 166/367
6,422,791 B1 * 7/2002 Pallini, Jr. ..... E21B 17/017 166/355
7,591,316 B2 * 9/2009 Hatton ..... E21B 17/015 166/350
8,282,317 B2 * 10/2012 de Kerdanet ..... E21B 17/012 405/218
2012/0085544 A1 * 4/2012 Shilling ..... E21B 17/015 166/345
2013/0014687 A1 * 1/2013 Wijning ..... B63B 35/4413 114/264
2014/0231326 A1 * 8/2014 Biley ..... E02B 15/10 210/170.05
2016/0304170 A1 * 10/2016 Guffee ..... B63B 27/34

OTHER PUBLICATIONS

International Preliminary Report on Patentability issued in related Application No. PCT/US2014/012507, dated Aug. 4, 2016 (11 pages).

* cited by examiner

DEPLOYMENT OF HIGH-PRESSURE IRON FROM MARINE VESSEL TO OFFSHORE RIG

CROSS-REFERENCE TO RELATED APPLICATION

The present application is a U.S. National Stage Application of International Application No. PCT/US2014/012507 filed Jan. 22, 2014, which is incorporated herein by reference in its entirety for all purposes.

BACKGROUND

The present disclosure relates to a system and method for the deployment of a conduit system to convey fluids from a marine vessel to an offshore rig.

Over the years, offshore oil exploration and production has become increasingly important to access hydrocarbon reserves that were previously unavailable. The existence of offshore fields located underwater has led to the development of specialized techniques and equipment to explore and produce hydrocarbons from these fields. While many of the basic processes (e.g., drilling or fracturing) operate according to the same principals as they do on land, the remote locations of the rigs and the unique conditions of underwater drilling can create challenges for offshore rigs or drilling platforms that their land-based counterparts do not experience.

One example of the challenges associated with offshore drilling and production is the logistical difficulty associated with transporting supplies and materials to an offshore drilling site. Ships or other marine vessels generally transport heavy equipment, fluids used in oil field work (e.g., drilling fluid or fracturing fluid), and other materials to the offshore rig. While operators can use cranes to transfer equipment or other solid structures from the marine vessel to the offshore rig, such equipment cannot be used to transfer them from the marine vessel to the offshore rig.

In current practice, operators typically use a flexible hose to transfer large volumes of fluids from the marine vessel to the offshore rig by connecting the two structures directly. During typical operations, the flexible hose is reeled or spooled on the marine vessel that transports the fluid to the offshore rig. After the marine vessel approaches the offshore rig, the operator connects the hose to the rig to form a conduit between the vessel and the rig. This allows the fluid to be pumped to the rig and, if appropriate, to the wellbore. In one example, this arrangement may be used to conduct offshore fracturing work in which the operator pumps the fracturing fluid off the marine vessel to the offshore rig at high pressures through the flexible hose.

However, the traditional use of a flexible hose has a number of disadvantages. These hoses can take a long time to manufacture, and therefore may not be readily available. The flexible hoses are also not typically made with both the diameter and pressure rating that is optimal for fracturing work. In particular, hoses with larger diameters tend to have lower pressure ratings. Moreover, flexible hoses are generally not buoyant. If the hose must be detached at one end (e.g., the marine vessel or the offshore rig) for emergency reasons, it may be suspended from its other end but otherwise sink into the water. If the hose must be detached from both ends, or detached from the marine vessel before it is connected to the offshore rig, then the hose can potentially be lost underwater.

BRIEF DESCRIPTION OF THE DRAWINGS

These drawings illustrate certain aspects of some of the embodiments of the present disclosure, and should not be used to limit or define the invention.

Figure 1:
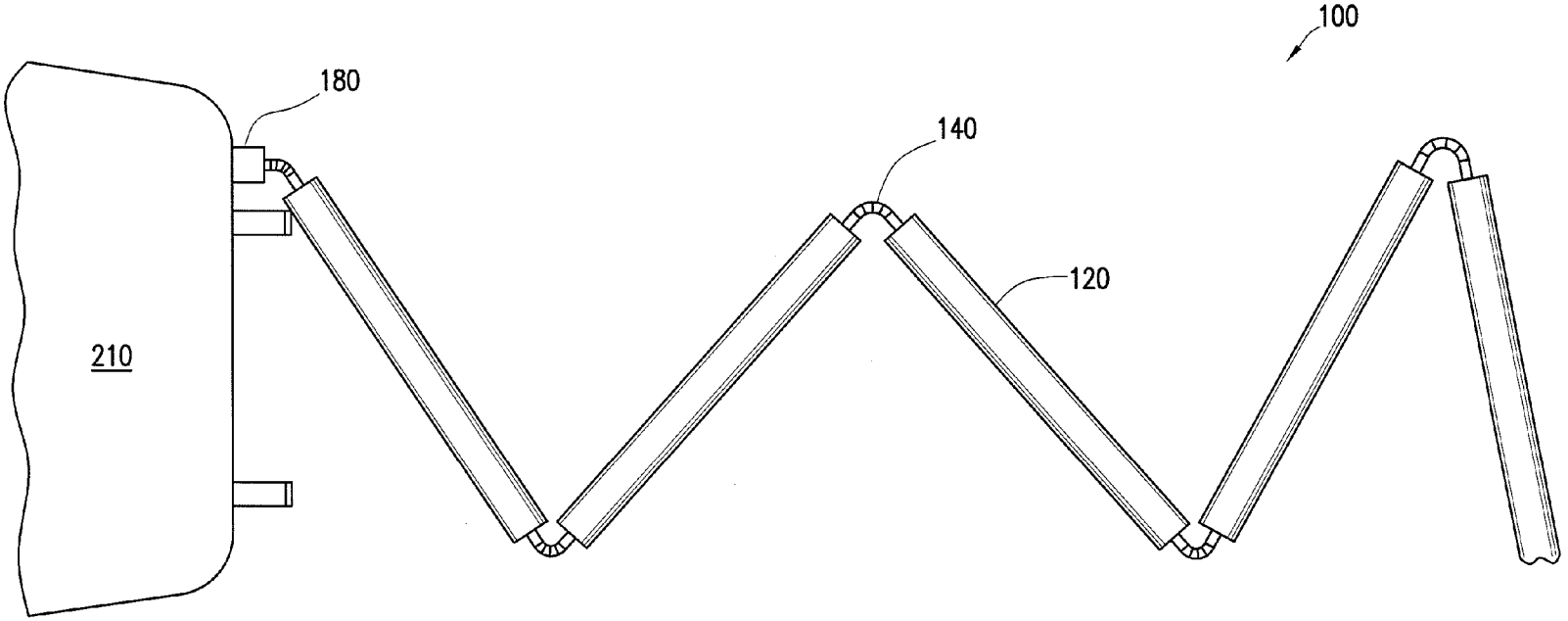
FIG. 1 illustrates a top-down view of an example conduit system after it has been deployed, in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF PREFERRED EMBODIMENTS

The present disclosure relates to a system and method for the deployment of a conduit system to convey fluids from a marine vessel to an offshore rig. This can be used, among other purposes, for providing well fracture treatments and sand control treatments.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to a conduit system using buoyant coverings for encasing high-pressure conduit to provide flexibility of the marine vessel location when using dynamic positioning to maintain a marine vessel in relation to the offshore rig. Certain embodiments may include several pieces of straight conduit, several buoyancy devices made of a buoyant material, and flexible joints between the pieces of straight conduit that allow for an accordion-like deployment of this conduit system between the marine vessel and the offshore rig. In certain embodiments, the flexible joints may also be covered with an external covering to protect and collect fluid in the case of a leak.

In certain embodiments, the conduit system may be transported on the stern of a marine vessel to and from offshore rigs and then deployed upon arrival with the assistance of a rig crane or a vessel crane, if available. The combination of the buoyancy devices and the flexible joints may allow for deployment and retraction of the entire conduit system to perform the pumping event. The flexible joints between the pieces of straight conduit may allow for movement of the conduit system in multiple directions. This flexibility and movement of the conduit system also may allow for position movement of the marine vessel as well as compensating for wave action. In certain embodiments, a quick release device may be applied to the vessel end of the conduit system for emergency disconnect. This would leave the entire conduit system floating on top of the water (due to the buoyancy devices) and still attached to the offshore rig.

FIG. 1 illustrates a top-down view of one example conduit system 100 while it is in use (i.e., after it has been deployed from a marine vessel), in accordance with certain embodiments of the present disclosure. The conduit system 100 may include a plurality of relatively straight sections 120 connected to each other by flexible joints 140. The conduit system 100 may be deployed off a marine vessel 210 such that one end of the conduit system 100 remains connected to the marine vessel 210. In certain embodiments, the marine vessel 210 may be a self-powered ship or a barge. In certain embodiments, the conduit system 100 is deployed from the stern of the marine vessel 210. As illustrated in FIG. 1, the conduit system 100 is able to expand and contract as the flexible joints 140 permit the angle between the sections 120 to change.

The conduit system 100 may be connected to the marine vessel 210 directly or indirectly using a quick release device 180, as shown in FIG. 1. The quick release device 180 may be any connection device known in the art that is capable of disconnecting quickly under emergency conditions. The quick release device 180 allows the operator to immediately detach the conduit system 100 from marine vessel 210 in emergency situations where the marine vessel 210 or the offshore rig would otherwise be placed at risk. Situations requiring an emergency detachment include, for example, a malfunction of the marine vessel's engine or controls, a change in weather conditions, or an emergency condition on the offshore rig.

Figure 2:
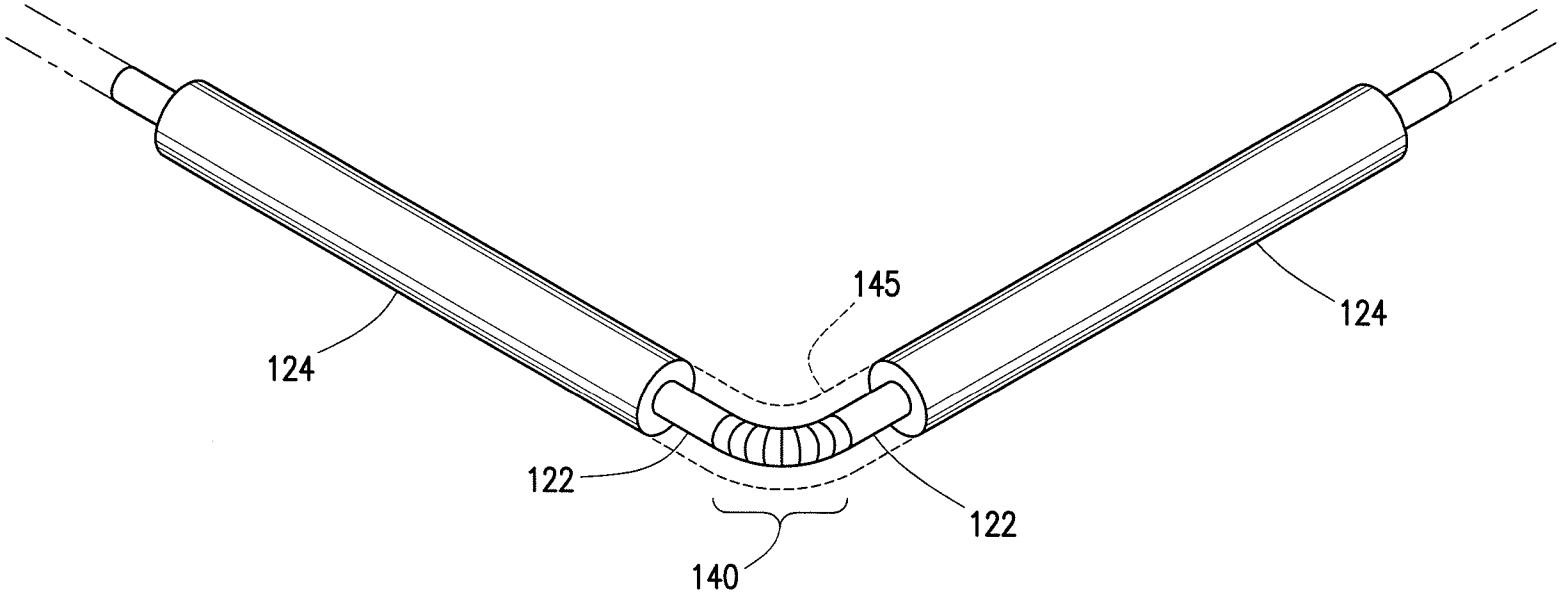
FIG. 2 illustrates a view of a portion of an example conduit system, in accordance with certain embodiments of the present disclosure.

FIG. 2 illustrates a detailed view of a portion of the example conduit system 100, in accordance with certain embodiments of the present disclosure. The section 120 comprises two components, a tubing section 122 and a buoyancy device 124. In certain embodiments, the buoyancy device 124 is wrapped around the tubing section 122 and encases the tubing section 122. In other embodiments, the buoyancy device 124 may only partially surround the tubing section 122. In certain embodiments, flexible joints 140 connect the sections 120 by attaching directly to the tubing section 122 of each section 120. FIG. 2 illustrates an exemplary embodiment in which the sections 120 have a circular cross-section; however other cross-sections are possible, including but not limited to, square cross-sections.

Several types of tubing sections 122 may be used according to the present disclosure. In certain embodiments, the tubing sections 122 are a metal pipes or tubes. In certain preferred embodiments, the tubing sections 122 are lengths of high-pressure iron. A suitable example of a high-pressure iron is a Weco® pup joint, available from FMC Corporation. The tubing sections 122 are capable of maintaining a sufficient working pressure. In certain embodiments, the sufficient working pressure is at least about 15,000 psi. In preferred embodiments, the sufficient working pressure is at least about 20,000 psi. In certain embodiments, the diameter of the tubing sections 122 may range from about 3 inches to about 7 inches. In certain embodiments, the length of the tubing sections 122 may range from about 40 feet to about 60 feet. With the benefit of this disclosure, a person of skill in the art can determine the optimal diameter and length of the tubing sections 122 based on, for example, the desired volume and rate of fluid transfer, the size of the vessel 210, and/or other factors.

Several types of buoyancy devices 124 may be used according to the present disclosure. Suitable buoyancy devices 124 are structures having a density less than about the density of sea water. In preferred embodiments, the buoyancy device 124 is made from a buoyant material that is durable and lasts in sea water without degrading. Examples of suitable buoyant material include, but are not limited to, rubber, polypropylene, and polyethylene. In certain embodiments, the buoyant material may be a foam. In certain embodiments, the buoyancy device 124 may have compartments that can be selectively flooded. These compartments allow the average density—and associated buoyancy—of the buoyancy device 124 to be selectively adjusted during deployment of the conduit system 100. In preferred embodiments, the compartments of the buoyancy device 124 may be selectively flooded by opening or closing a valve. In other embodiments, the compartments of the buoyancy device 124 may be inflated with air or another gas to increase the volume of the buoyancy device 124.

A variety of flexible joints 140 may be used according to the present disclosure. The flexible joint 140 allows the angle between the two sections 120 it connects to vary within a non-trivial range of degrees. In preferred embodiments, the flexible joint 140 permits this angle to vary from about 0 degrees (where the two sections 120 are positioned adjacent and parallel to each other) to about 180 degrees (where the two sections 120 are positioned end-to-end). The flexible joints 140 are capable of maintaining a sufficient working pressure. In certain embodiments, the sufficient working pressure is at least about 15,000 psi. In preferred embodiments, the sufficient working pressure is at least about 20,000 psi. Suitable flexible joints may include market swivel joints available from companies such as FMC Technologies or Weir SPM.

In certain embodiments, the flexible joint 140 may be enclosed by a sleeve 145. The sleeve 145 may be added, among other reasons, to prevent corrosion and/or provide environmental protection. The sleeve 145 may prevent fluids from getting into the environment in the event of a leak and may also prevent salt water from coming into contact with the flexible joint 140. The sleeve 145 may be made from a variety of materials including, but not limited to, rubber, polypropylene, and polyethylene. The sleeve 145 may be any size or thickness provided it does not interfere with the operation of the conduit system 100.

Figure 3:
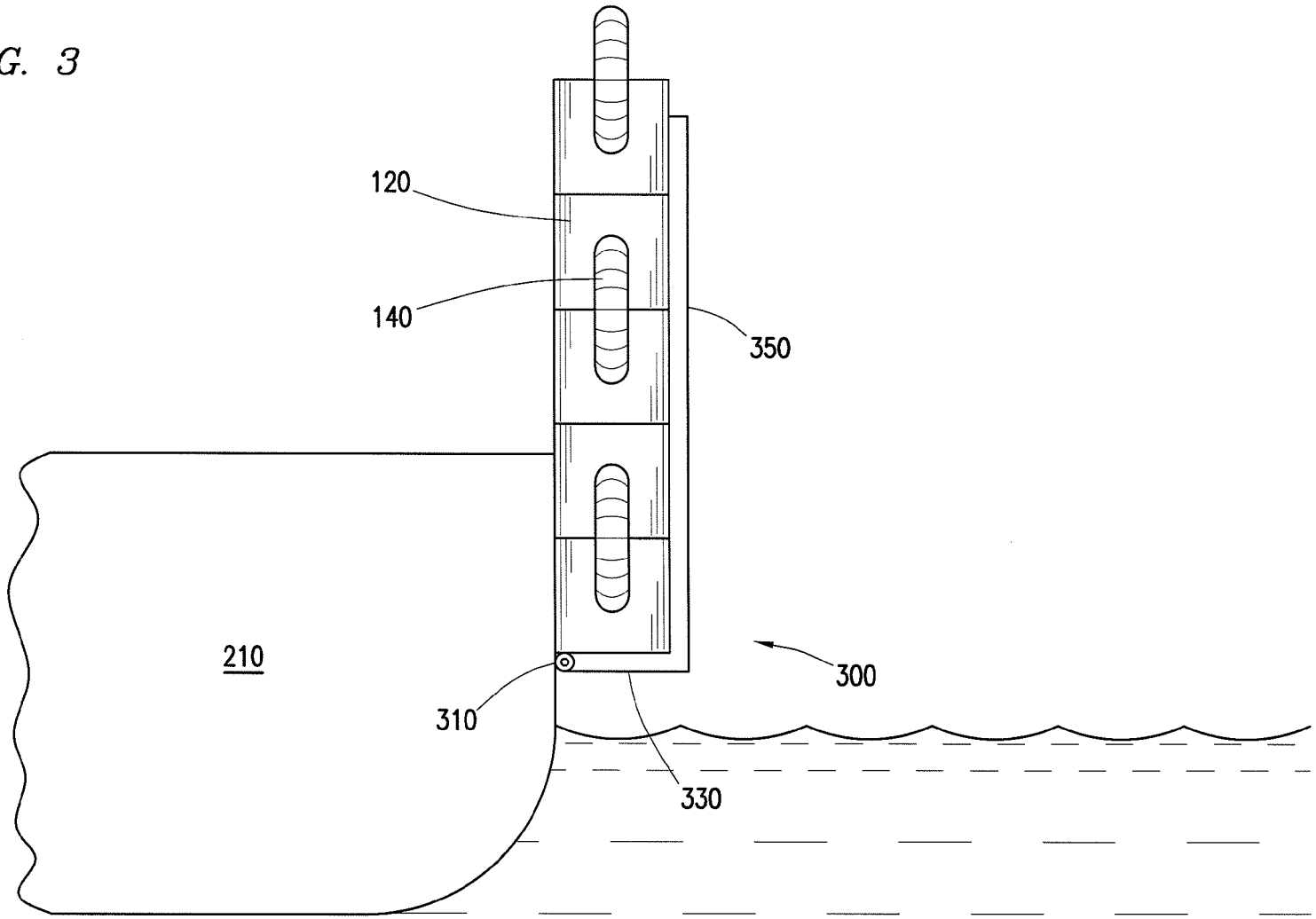
FIG. 3 illustrates a side-view of an example conduit system before it has been deployed and while it is located on the stern of a marine vessel, in accordance with certain embodiments of the present disclosure.

FIG. 3 illustrates the example conduit system 100 before it has been deployed and while it is located on the stern of a marine vessel 210, in accordance with certain embodiments of the present disclosure. In particular, FIG. 3 depicts one example of a transportation configuration of the conduit system 100. In this transportation configuration, the longitudinal axis of each section 120 is parallel to the rear edge of the stern of the marine vessel 210. Each of the sections 120 is stacked. While FIG. 3 depicts a single stack of sections 120, the conduit system 100 may be transported in multiple stacks in other embodiments. A person of skill in the art may determine the optimal configuration, with the benefit of this disclosure, based on factors including the desired length of the conduit system 100 and the size of the marine vessel 210.

FIG. 3 provides a side-view of the marine vessel 210 and, therefore, only shows the end of each of the sections 120. FIG. 3 also illustrates several of the flexible joints 140 that connect the sections 120. However, due to its side-view orientation, FIG. 3 shows only every other flexible joint 140. This includes, for example, the flexible joints 140 connecting the first and second sections 120 (counting from the bottom) and the flexible joints 140 connecting the third and fourth sections 120. In contrast, the flexible joint 140 connecting the second and third sections 120 is located at the other end of those sections and is therefore not visible from the side-view orientation of FIG. 3.

In the example transportation configuration illustrated by FIG. 3, the conduit system 100 is supported by a rotatable deployment frame 300. In certain embodiments, the deployment frame 300 is connected to the stern of the marine vessel 210 by a hinge 310. In certain embodiments, the deployment frame 300 consists of a base portion 330 and a plurality of elongate fingers 350. In certain embodiments, base portion 330 is a flat structure that is parallel to the sections 120 when they are in the transportation configuration, and it supports the lower-most sections 120. The base portion 330 may be a sheet, a grate, a grill, or any similar structure of sufficient strength to support the conduit system 100. In certain embodiments, the elongate fingers 350 attach to the base portion 330 at an approximately right angle and are also approximately perpendicular to the sections 120 while the conduit system 100 is in the transportation configuration.

Figure 4:
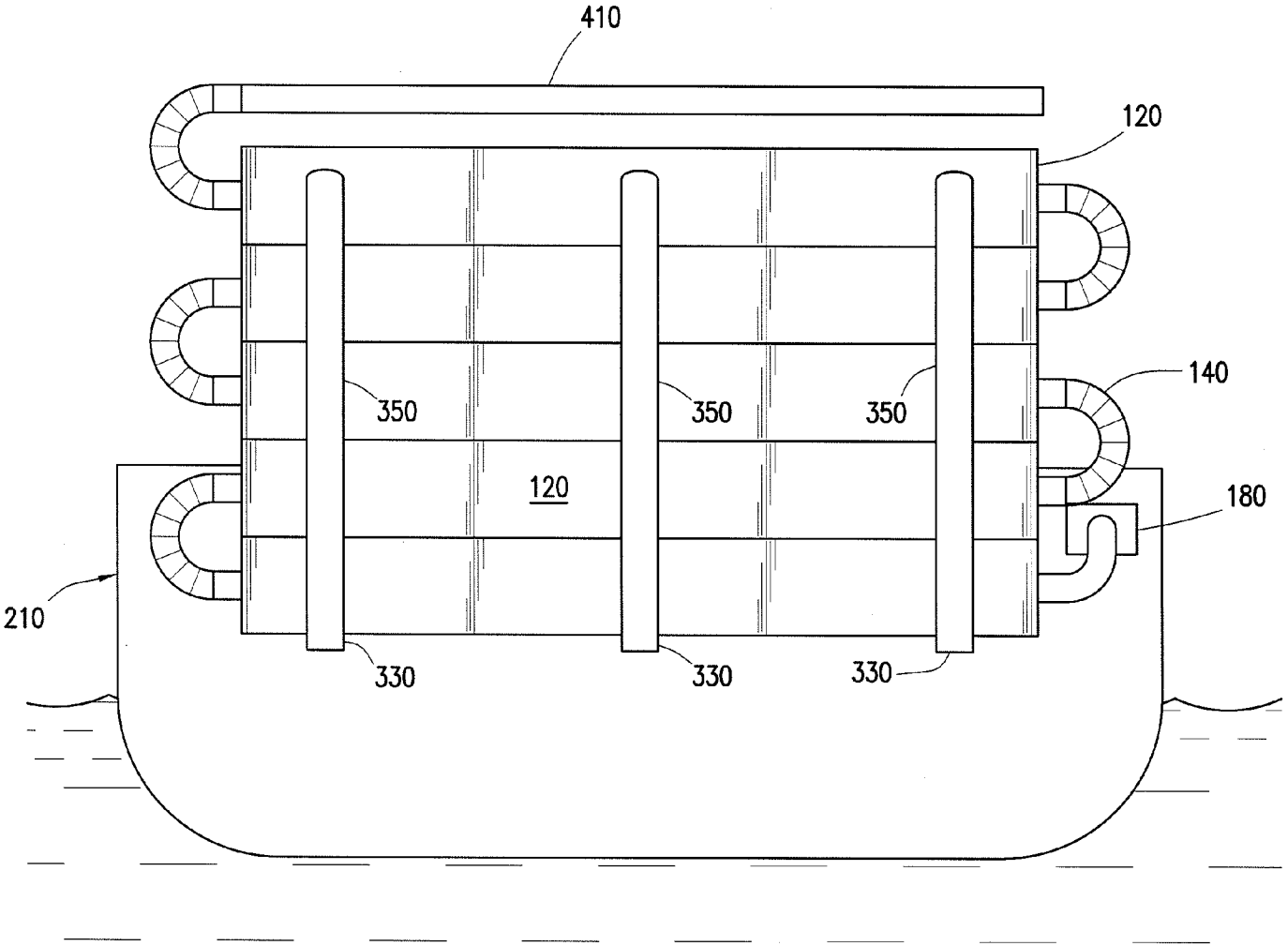
FIG. 4 illustrates a rear-view of an example conduit system before it has been deployed and while it is located on the stern of a marine vessel, in accordance with certain embodiments of the present disclosure.

FIG. 4 illustrates the conduit system 100 before it has been deployed and while it is located on the stern of a marine vessel 210, in accordance with certain embodiments of the present disclosure. FIG. 4 shows the same configuration as FIG. 3, but illustrates embodiment from a point-of-view directly behind the marine vessel 210. As FIG. 4 illustrates, a plurality of elongate fingers 350 support the sections 120 as they rest on the base portion 330 of the rotatable deployment frame 300. FIG. 4 also shows that the conduit system 100 may be connected to the marine vessel by a quick release device 180. A hanger 410 (i.e., riser joint) can also be seen in the exemplary embodiment depicted by FIG. 4. The hanger 410 may be the same type of hanger that is currently used with flexible hoses. It is used to connect the conduit system 100 to the offshore rig. Prior to the deployment of the conduit system 100, the hanger 410 may rest parallel or perpendicular to the sections 120.

Figure 5:
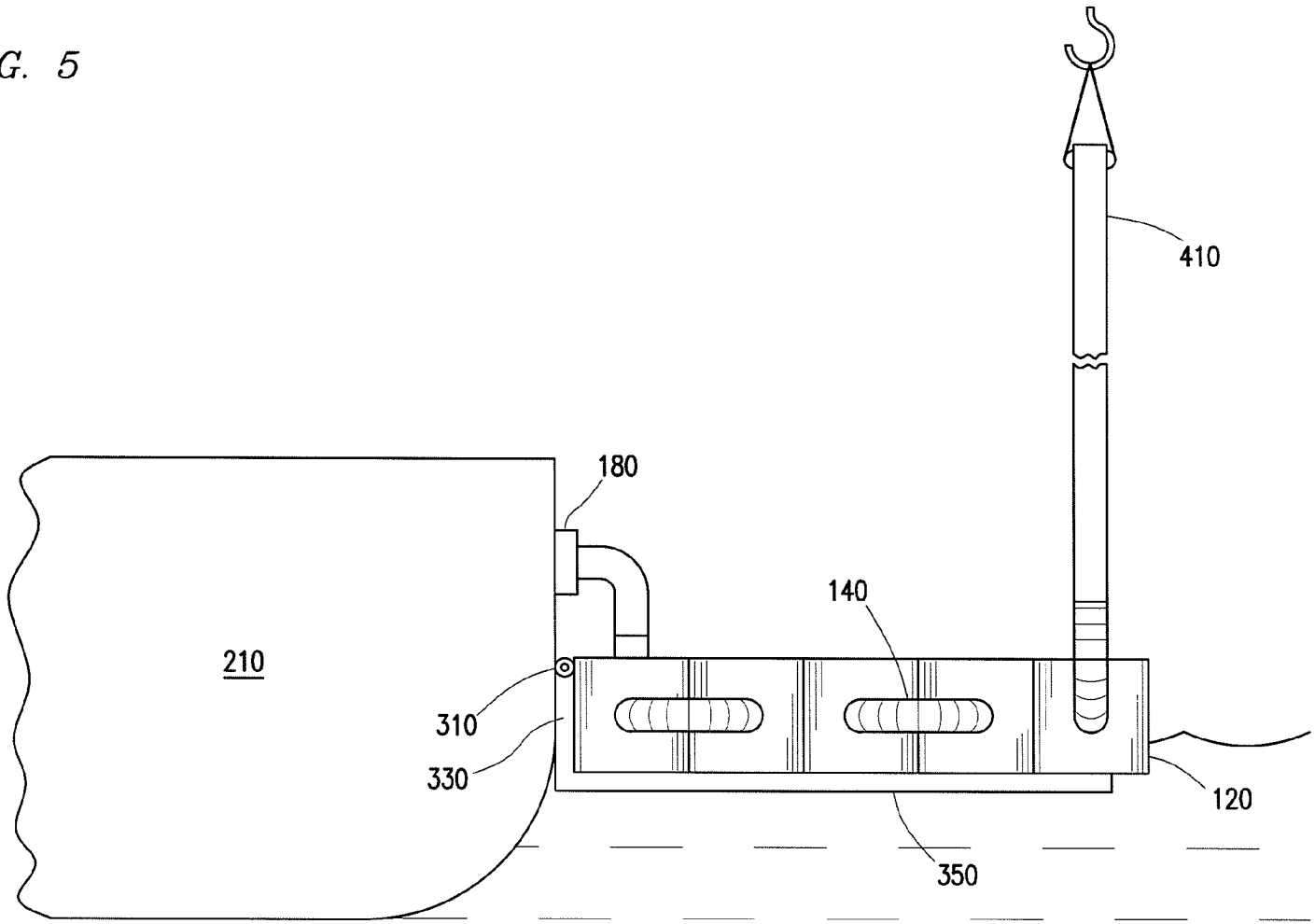
FIG. 5 illustrates a side-view of an example conduit system as it is being deployed from the stern of a marine vessel, in accordance with certain embodiments of the present disclosure.

FIG. 5 illustrates a side-view of the conduit system 100 as it is being deployed from the stern of a marine vessel 210, in accordance with certain embodiments of the present disclosure. As illustrated in FIG. 5, the conduit system 100 may be deployed by rotating the deployment frame 300 by approximately 90 degrees about the hinge 310. This causes the elongate fingers 350, which support the conduit system 100 during the rotation, to be lowered into the water. Due to the buoyancy devices 124, the conduit system 100 floats. After the elongate fingers 350 are lowered into the water, the conduit system is free to be deployed. The framework of the base portion 330 and the elongate fingers 350 also form a barrier that prevents the conduit system 100 from contacting the propellers (not shown) or otherwise getting caught under the marine vessel 210. When the conduit system 100 is deployed, a crane from the offshore rig may be used to lift the hanger 410 and connect the unattached end of the conduit system 100 to the offshore rig.

While the present disclosure illustrates the conduit system 100 being deployed from the stern of the marine vessel 210, a person of ordinary skill in the art would recognize that the conduit system 100 could also be deployed from the front or the side of the vessel. Factors to consider while determining the optimal location include the size of the marine vessel 210, the layout of the marine vessel 210, and the size of the conduit system 100.

An embodiment of the present disclosure is a conduit connected to a marine vessel, the conduit comprising: a plurality of sections of tubing; a plurality of flexible joints connecting the sections of tubing; and a buoyancy device at least partially surrounding at least one of the sections of tubing and having a density less than the density of seawater. Optionally, the sections of tubing comprise high-pressure iron. Optionally, the flexible joint is enclosed by a sleeve. Optionally, both the sections of tubing and the flexible joints are capable of maintaining a pressure of at least about 15,000 psi. Optionally, the buoyancy device comprises compartments that can be selectively flooded. Optionally, the buoyancy device comprises polypropylene or polyethylene. Optionally, the conduit system is connected to the marine vessel using a quick release device.

Another embodiment of the present disclosure is a system comprising: a conduit comprising: a plurality of sections of tubing; a plurality of flexible joints connecting the sections of tubing; and a buoyancy device at least partially surrounding at least one of the sections of tubing and having a density less than the density of seawater; and a deployment frame that supports the conduit while the conduit is in a transportation configuration. Optionally, the deployment frame comprises a base portion and a plurality of elongate fingers. Optionally, the deployment frame is mounted to a marine vessel. Optionally, the deployment frame is rotatably mounted using a hinge. Optionally, the sections of tubing comprise high-pressure iron. Optionally, the flexible joint is enclosed by a sleeve. Optionally, the buoyancy devices comprise compartments that can be selectively flooded.

Another embodiment of the present disclosure is a method comprising: providing a conduit comprising: a plurality of sections of tubing; a plurality of flexible joints connecting the sections of tubing; and a buoyancy device at least partially surrounding at least one of the sections of tubing and having a density less than the density of seawater; connecting one end of the conduit to a marine vessel; connecting the other end of the conduit to an offshore rig; and transferring fluid through the conduit between the marine vessel and the offshore rig. Optionally, the sections of tubing comprise high-pressure iron. Optionally, the flexible joint is enclosed by a sleeve. Optionally, both the sections of tubing and the flexible joints are capable of maintaining a pressure of at least about 15,000 psi. Optionally, the buoyancy device comprises compartments that can be selectively flooded. Optionally, the buoyancy device comprises polypropylene or polyethylene.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A conduit connected to a marine vessel, the conduit comprising:

a plurality of sections of tubing;

a plurality of flexible joints connecting the sections of tubing;

a buoyancy device at least partially surrounding at least one of the sections of tubing and having a density less than the density of seawater;

wherein the conduit is supported by a deployment frame rotatably mounted via a hinge to the marine vessel; and wherein the conduit is deployable by the deployment frame.

2. The conduit of claim 1 wherein the sections of tubing comprise high-pressure iron.

3. The conduit of claim 1 wherein the flexible joint is enclosed by a sleeve.

4. The conduit of claim 1 wherein both the sections of tubing and the flexible joints are capable of maintaining a pressure of at least about 15,000 psi.

5. The conduit of claim 1 wherein the buoyancy device comprises compartments that can be selectively flooded.

6. The conduit of claim 1 wherein the buoyancy device comprises polypropylene or polyethylene.

7. The conduit of claim 1 wherein the conduit system is connected to the marine vessel using a quick release device.

8. A system comprising:

a conduit comprising:

a plurality of sections of tubing;

a plurality of flexible joints connecting the sections of tubing; and a buoyancy device at least partially surrounding at least one of the sections of tubing and having a density less than the density of seawater; and a deployment frame that supports the conduit while the conduit is in a transportation configuration, wherein the deployment frame is mounted to a marine vessel, and wherein the deployment frame is rotatably mounted using a hinge.

9. The system of claim 8 wherein the deployment frame comprises a base portion and a plurality of elongate fingers.

10. The system of claim 8 wherein the sections of tubing comprise high-pressure iron.

11. The system of claim 8 wherein the flexible joint is enclosed by a sleeve.

12. The system of claim 8 wherein the buoyancy devices comprise compartments that can be selectively flooded.

13. A method comprising:

providing a conduit comprising:

a plurality of sections of tubing;

a plurality of flexible joints connecting the sections of tubing; and a buoyancy device at least partially surrounding at least one of the sections of tubing and having a density less than the density of seawater;

connecting one end of the conduit to a marine vessel;

deploying the conduit via a deployment frame rotatably mounted via a hinge to the marine vessel;

connecting the other end of the conduit to an offshore rig; and transferring fluid through the conduit between the marine vessel and the offshore rig.

14. The method of claim 13 wherein the sections of tubing comprise high-pressure iron.

15. The method of claim 13 wherein the flexible joint is enclosed by a sleeve.

16. The method of claim 13 wherein both the sections of tubing and the flexible joints are capable of maintaining a pressure of at least about 15,000 psi.

17. The method of claim 13 wherein the buoyancy device comprises compartments that can be selectively flooded.

18. The method of claim 13 wherein the buoyancy device comprises polypropylene or polyethylene.

* * * * *